US005147449A

United States Patent [19]

Grewe et al.

[11] Patent Number: 5,147,449

[45] Date of Patent: Sep. 15, 1992

[54] PROCESS FOR PRODUCTION OF METAL-METALMETALLOID POWDERS WITH THEIR ARTICLES HAVING ULTRAMICROCRYSTALLINE TO NANOCRYSTALLINE STRUCTURE

[75] Inventors: Hans Grewe, Grefrath-Vinkrath; Wolfgang Schlump, Essen, both of Fed. Rep. of Germany

[73] Assignee: Fried. Krupp Gesellschaft mit Beschrankter Haftung, Essen, Fed. Rep. of Germany

[21] Appl. No.: 336,664

[22] Filed: Apr. 11, 1989

[30] Foreign Application Priority Data

Apr. 20, 1988 [DE] Fed. Rep. of Germany ..... 3813224

[51] Int. Cl.[5] ..... C22C 1/10

[52] U.S. Cl. ..... 75/354; 75/956

[58] Field of Search ..... 75/0.5 R, 0.5 B, 0.5 BB, 75/0.5 BC, 354, 956

[56] References Cited

U.S. PATENT DOCUMENTS 4,624,705 11/1986 Jatkar et al. ..... 148/11.5 Q
4,737,340 4/1988 Dolgin ..... 420/129

FOREIGN PATENT DOCUMENTS 0203311 12/1986 European Pat. Off. .
0232772 8/1987 European Pat. Off. .
2239535 2/1975 France .

OTHER PUBLICATIONS

Merriman, "A Dictionary of Metallurgy", MacDonalds and Evans, Ltd., London, England, 1958, pp. 48–52 and 114–115.

*Primary Examiner*—George Wyszomierski
*Attorney, Agent, or Firm*—Spencer, Frank & Schneider

[57] ABSTRACT

A process for producing metal metalmetalloid powder, with its particles having ultramicrocrystalline structures to nanocrystalline structures with the metalmetalloid component being composed of at least one metal reacted with at least one metalloid of the group including C, N, O, H, B, and Si. The metalloids, C, N, O, H, B, and Si are introduced in a highly reactive form together with powders of the metals of the matrix metal and of the metals of the metalmetalloid component into a high energy mill to produce a metal-metalmetalloid powder with its particles having a ultramicrocrystalline to nanocrystalline structure both in the metal matrix and in the metal metalloid component.

7 Claims, 3 Drawing Sheets

Enlargement: 200000:1 ⟼ 100nm

Enlargement: 100 000 : 1 ⊢⊣ 100 n m

Enlargement: 100 000 : 1 ⊢⊣ 100 n m

Enlargement: 200 000:1 100 n m

Enlargement: 100 000:1 100 n m

Enlargement: 100 000 : 1 ⟼ 100 nm

Enlargement: 100 000 : 1 ⟼ 100 nm

PROCESS FOR PRODUCTION OF METAL-METALMETALLOID POWDERS WITH THEIR ARTICLES HAVING ULTRAMICROCRYSTALLINE TO NANOCRYSTALLINE STRUCTURE

FIELD OF THE INVENTION

This invention relates to the production of metal-metalmetalloid powders their particles having an ultramicrocrystalline to nanocrystalline structure for use in making molded parts with ultramicrocrystalline to nanocrystalline structure.

TECHNOLOGY REVIEW

The process for production of metal-metalmetalloid powder with its particles having nanocrystalline structure is known from DE OS 37 14 239. In this known process metal powder and metalmetalloid powder are milled together with high energy to produce the metal-metalmetalloid powder, which is an alloy of the starting powders. Before milling these powders the powder of the metalmetalloid compound has to be produced.

SUMMARY OF THE INVENTION

It is therefore an object of the present invention to provide a process for the production of a metal-metalmetalloid powder with its particles having ultramicrocrystalline to nanocrystalline structure with which the metalmetalloid compound of the metal-metalloid powder is first prepared by reaction of its metal component with its metalloid component during milling. Therefore the starting materials for the process of the invention are a first metal powder for the matrix and a second metal powder for the metalmetalloid component and the metalloids, all of which are in a highly reactive form.

DETAILED DESCRIPTION OF THE INVENTION

The present invention provides a simplified process for producing metal-metalmetalloid powders having ultramicrocrystalline to nanocrystalline structures. The starting materials include a powder of a metal matrix and another metal powder for the metal components of the metalmetalloid compounds. The metal matrix is the binder phase. Typical metal matrix materials include nickel, chromium, cobalt, and alloys thereof.

The metals of the metalmetalloid component are advantageously chosen from those metals which react with a metalloid selected from the group consisting of carbon, nitrogen, oxygen, hydrogen, boron and silicon. Preferably the metalmetalloid reaction yields a negative enthalpy of formation at the actual reaction temperature. Preferred metals for a metalmetalloid compound of the metalmetalloid component include Ti, Zr, Hf, V, Nb, Ta, Cr, Mo, Wr, Si and Al. The reaction temperatures for these metals with the above-mentioned metalloids are typically in the range from about 200° C. to to about 400° C. concerning microlocal positions, that is the temperature defined for a very small region may vary from position to position in the range given.

The metalloid elements used in the process of the present invention are used in a highly reactive form. For example, the solid metalloid components which may be used in the process of the present invention are selected from the group consisting of carbon, boron and silicon. These elements are used in a highly reactive form. For example, carbon is used as lamp black, that is in the form of activated carbon having a large specific area. Similarly the other solid metalloids are used in a finely divided form having high values of specific area. Another possibility or further increase of the highly active form is produced by a high degree of disorder of the lattice of the solids. The gaseous metalloid elements which may be used in the process of the present invention include nitrogen, oxygen and hydrogen. These gaseous metalloid elements are by their physical state (gas under atmosphere pressure) in any case in a higher reactive form than the solids C, B, Si. This highly reactive form will be further increased by a high degree of dissociation, which is e.g. produced by applying starting metal powders of irregular, sharpshaped particles. According to the present invention, the metalmetalloid component of the powder is formed by reacting quantitatively a metal as described above and a highly reactive form of a metalloid as described above during the milling operation, so that as result of the milling the metal of the metalmetalloid compounds exists only in reacted form in the metalmetalloid compound.

DESCRIPTION OF THE PREFERRED EMBODIMENTS

In order that those skilled in the art may better understand how the present invention may be practiced, the following examples are given by way of illustration and not by way of limitation. All parts and percentages are by mass unless otherwise noted.

EXAMPLE 1

Figure 1:
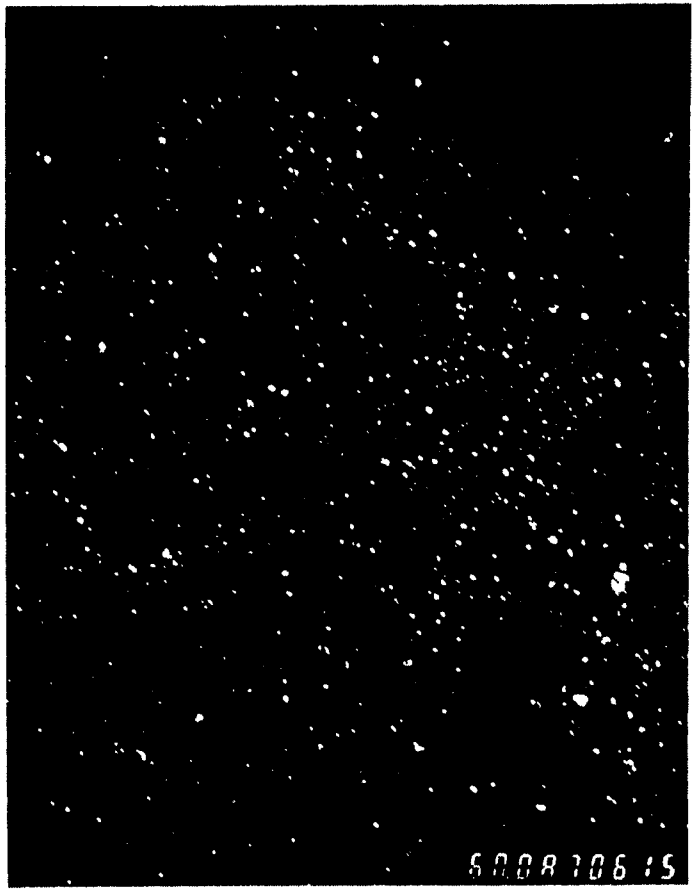
FIG. 1 is a TEM (transmission electron microscope) photograph of titanium oxide having an ultramicrocrystalline structure in a nickel matrix.

A titanium-nickel powder (70:30 mass-%) was used as the starting powder mixture. The milling process was carried out with air under atmospheric pressure, for 8 hours in a planetary mill operating at 12 G. The TEM (transmission electron microscope) photograph of FIG. 1 shows the set structures developed by the process. TiO is formed quantitatively in the metallic matrix, and the photograph shows that the TiO has an ultramicrocrystalline structure.

EXAMPLE 2

Figure 2:
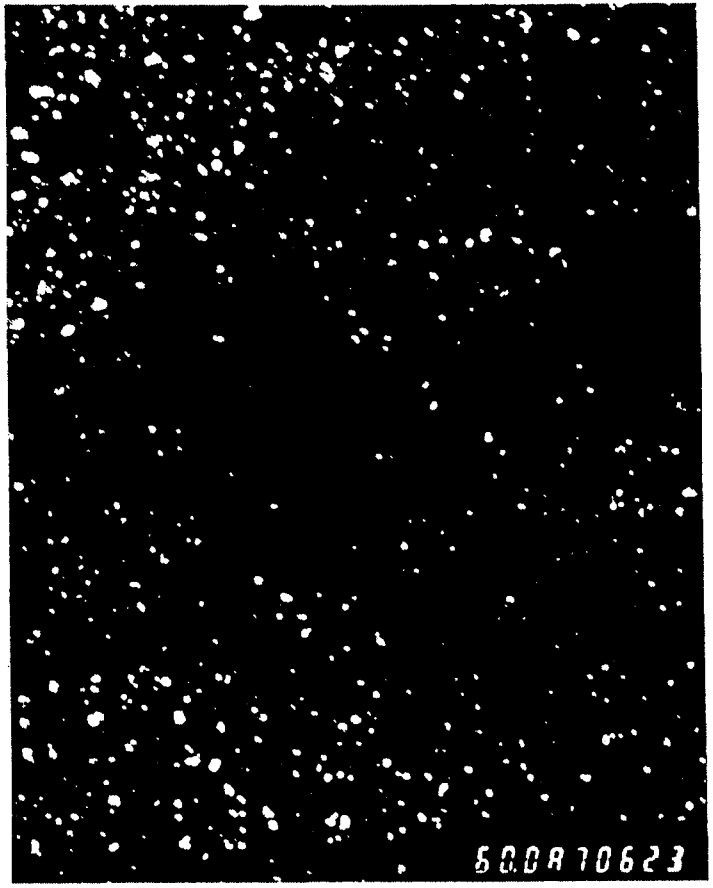
FIG. 2 is a TEM photograph of a titanium oxide in a chromium matrix.

A titanium-chromium powder (70:30 mass-%) was used as the starting powder. The milling process was carried out with air under atmospheric pressure in a planetary mill at 12 G. The milling time was 24 h. The TEM photograph of FIG. 2 shows the result of the set structures. Here again TiO is formed quantitatively in a metallic matrix.

As seen in Examples 1 and 2, the result of the reactive milling process with respect to the metalmetalloid powder is substantially independent on the metal matrix used, which may be nickel or chromium.

EXAMPLE 3

Figure 3:
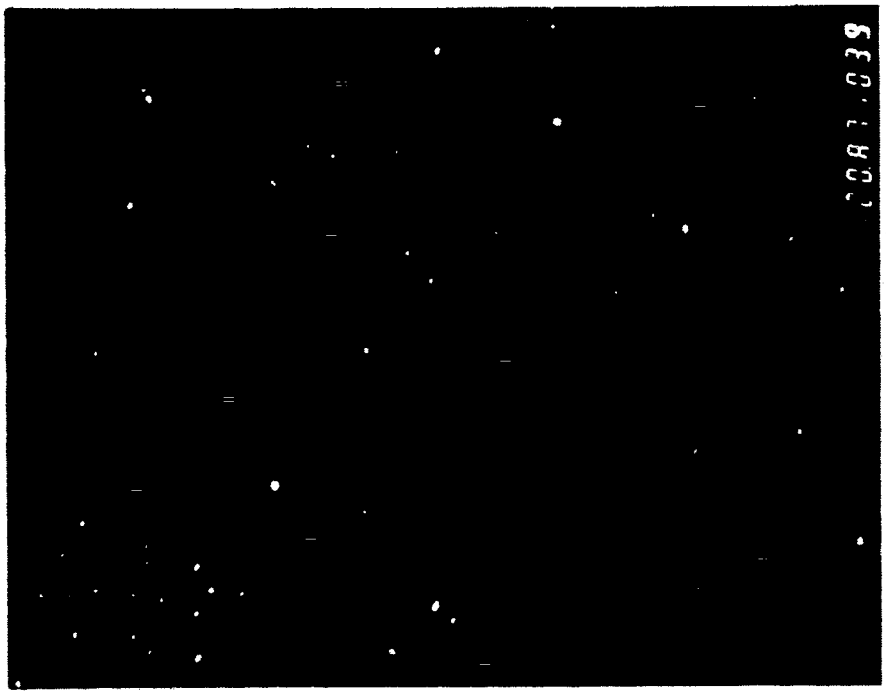
FIG. 3 is a TEM photograph of titanium nitride in a cobalt matrix; both the matrix and nitride phase are nanocrystalline.

A titanium-cobalt powder (70:30 mass-%) was used as the starting powder mixture. The milling process was carried out with nitrogen under atmospheric pressure in an attritor at 8 G. The milling time was 90 h. The development of titanium nitride was quantitative. The TEM photograph of FIG. 3 shows a result titanium nitride in a metallic matrix. Both the matrix and the nitride phase are nanocrystalline.

EXAMPLE 4

Figure 4:
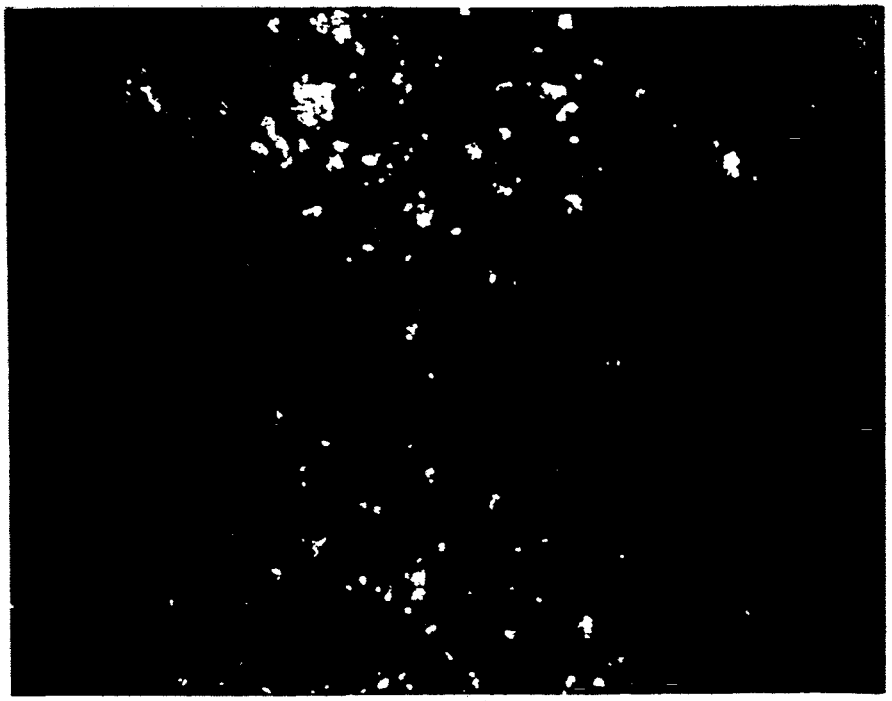
FIG. 4 is a TEM photograph of titanium carbide in a cobalt matrix.

A titanium-cobalt powder was used as the starting powder mixture. Carbon was added in the form of lamp black (62:26.5:11.5 mass-%). The powder and lamp black were milled for 48 h in a planetary mill at 12 G. The high specific surface area (35 to 40 $m^2/g$) of the lamp black made it a highly active metalloid component. The high energy processing of the material being milled in the planetary mill, in the initial state, resulted in the formation of relatively coarse titanium carbides (0.5 to 1 $\mu m$ grain size) which were sub-stoichiometric with reference to their carbon content. During continuation of the milling process, the titanium was alloyed with cobalt and became more finely crystalline. At the same time, the resulting titanium carbide crystallites also became increasingly more fine grained so that, in the final stage of the milling process, the titanium carbide was quantitative in an ultramicrocrystalline form, i.e. it became more and more nanocrystalline. The result after 48 h milling time is shown in the TEM photograph of FIG. 4.

EXAMPLE 5

Figure 5:
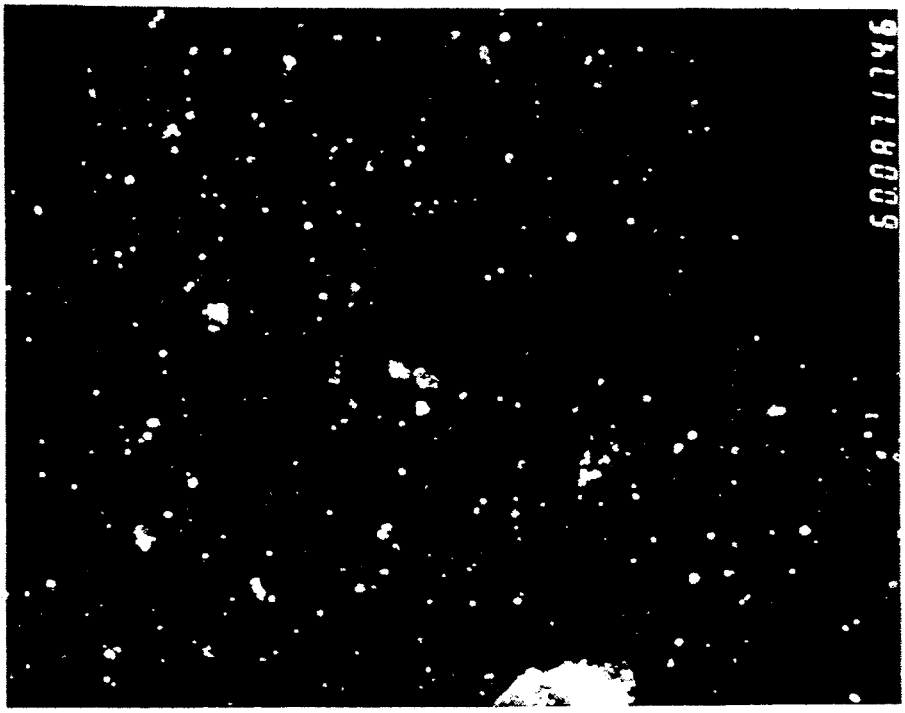
FIGS. 5 and 6 are TEM photographs of titanium carbide in a nickel matrix (FIG. 5) and in a cobalt-nickel matrix (FIG. 6).

A titanium-nickel-carbon powder (62:26.5:11.5 mass-%) was used as the starting powder mixture. By preliminary milling of the titanium-nickel powder mixture (for approximately 40 h), the partial formation of an alloy powder is obtained and with it the reaction facility is reduced. Then carbon was added to the material to be milled in the form of highly active lamp black and the resulting mixture was milled in an attritor for further 90 h. After a total of about 130 h of high energy processing, ultramicrocrystalline to nanocrystalline titanium carbides were developed quantitatively in a metallic binder phase which was rich in nickel. This phase was also substantially nanocrystalline. This result is shown at the TEM photograph of FIG. 5.

EXAMPLE 6

Figure 6:
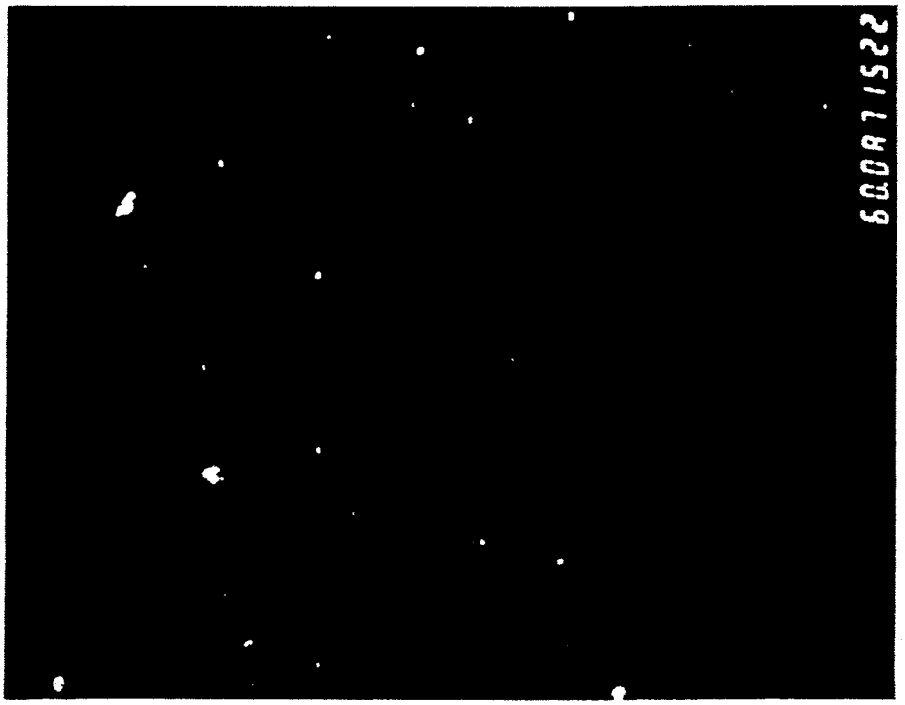

A tungsten-cobalt-nickel-carbon powder (79.5:7.95:7.95:4.6 mass-%) was used as the starting powder mixture. The milling time was 90 h. The carbon was again added in the form of highly active lamp black and the material was milled in an attritor at 8 G. The development of the carbides was quantitative. The TEM photograph of FIG. 6 shows carbides which are predominantly nanocrystalline.

It is understood that various other modifications will be apparent to and can readily be made by those skilled in the art without departing from the scope and spirit of this invention. Accordingly, it is not intended that the scope of the claims appended thereto be limited to the description as set forth above, but rather that the claims be construed as encompassing all of the features of patentable novelty which reside in the present invention, including all features which would be treatet as equivalents thereof by those skilled in the art to which this invention pertain.

What is chained is:

1. A process for producing a metal-metalmetalloid powder comprising a metal matrix and a metalmetalloid component including particles having an ultramicrocrystalline to nanocrystalline structure both in the metal matrix and in the metalmetalloid component, said process comprising the steps of:

mixing a metal powder consisting essentially of the intended matrix metal with a second metal powder to form a first powder mixture, adding at least one metalloid selected from the group consisting of C, N, O, H, B, Si in a highly reactive solid or gaseous form, to said first powder mixture to form a second powder mixture consisting of said metalloid, said matrix metal powder, and said second metal powder, and milling said second powder mixture with high energy in a mill, so as to react said second metal powder with said metalloid to produce a third powder mixture including a metalmetalloid component and said matrix metal, said third powder mixture comprising particles having an ultramicrocrystalline to nanocrystalline structure both in the matrix metal and in the metalmetalloid component.

2. The process as set forth in claim 1, wherein said mill is an attritor mill.

3. The process set forth in claim 1, wherein said mill is a planetary mill.

4. The process set forth in claim 1, wherein said mill includes milling elements accelerated to at least about 8 G.

5. The process set forth in claim 1, wherein said metalmetalloid has a negative enthalpy of formation compared to the metalloid at reaction temperatures from about 200° C. to about 400° C.

6. The process set forth in claim 1, wherein said metal of the second metal powder is selected from the group consisting of Al, Ti, Zr, Hf, V, Nb, Ta, Cr, Mo, W, and mixtures thereof.

7. The process set forth in claim 1, wherein said metal of the second metal powder is selected from the group consisting of Al and Si.

* * * * *